US011774111B2

(12) United States Patent
Lei et al.

(10) Patent No.: US 11,774,111 B2
(45) Date of Patent: Oct. 3, 2023

(54) FAN SYSTEM, RANGE HOOD EQUIPPED WITH THE SAME, AND MOUNTING METHOD THEREOF

(71) Applicant: NINGBO FOTILE KITCHEN WARE CO., LTD., Zhejiang (CN)

(72) Inventors: Gai Lei, Zhejiang (CN); Zhineng Xu, Zhejiang (CN); Lei Shi, Zhejiang (CN)

(73) Assignee: NINGBO FOTILE KITCHEN WARE CO., LTD., Zhejiang (CN)

( * ) Notice: Subject to any disclaimer, the term of this patent is extended or adjusted under 35 U.S.C. 154(b) by 0 days.

(21) Appl. No.: 17/776,234

(22) PCT Filed: Nov. 5, 2020

(86) PCT No.: PCT/CN2020/126721
§ 371 (c)(1),
(2) Date: May 12, 2022

(87) PCT Pub. No.: WO2022/088223
PCT Pub. Date: May 5, 2022

(65) Prior Publication Data

US 2022/0390124 A1 Dec. 8, 2022

(30) Foreign Application Priority Data

Oct. 30, 2020 (CN) ..... 202011190585.X

(51) Int. Cl.
*F24C 15/20* (2006.01)
*F04D 25/08* (2006.01)
*F04D 29/62* (2006.01)

(52) U.S. Cl.
CPC ..... *F24C 15/2042* (2013.01); *F04D 25/08* (2013.01); *F04D 29/626* (2013.01)

(58) Field of Classification Search
CPC ..... F24C 15/20; F24C 15/2042; F04D 17/16; F04D 25/0606; F04D 25/08; F04D 25/166; F04D 29/4226; F04D 29/626; F04D 29/668
See application file for complete search history.

(56) References Cited

U.S. PATENT DOCUMENTS

2016/0177957 A1* 6/2016 Santucci ..... F04D 25/0693 126/299 D

FOREIGN PATENT DOCUMENTS

CN 201476129 U * 5/2010
CN 102174941 9/2011
CN 102174941 A * 9/2011
(Continued)

OTHER PUBLICATIONS

"International Search Report (Form PCT/ISA/210) of PCT/CN2020/126721," dated Jul. 26, 2021, pp. 1-4.

*Primary Examiner* — Alexander B Comley
(74) *Attorney, Agent, or Firm* — JCIPRNET

(57) ABSTRACT

A fan system is provided, which includes a volute having a front cover, a rear cover and an annular wall connected between the front cover and the rear cover; an impeller disposed inside the volute, and a motor; the front cover has an air inlet facing downward in the state when the fan system is mounted; the motor includes a motor body and an edge; the edge is connected to the rear cover at the side of the rear cover facing the air inlet. A range hood equipped with the fan system and a mounting method for a flow guide device of the range hood are provided.

9 Claims, 11 Drawing Sheets

(56) References Cited

FOREIGN PATENT DOCUMENTS

| | | | | | |
|---|---|---|---|---|---|
| CN | 202902412 | U | * | 4/2013 | |
| CN | 104501244 | | | 4/2015 | |
| CN | 104501244 | A | * | 4/2015 | ..... F04D 17/04 |
| CN | 204313343 | U | * | 5/2015 | |
| CN | 105090121 | A | * | 11/2015 | ..... F24C 15/20 |
| CN | 105091058 | A | * | 11/2015 | ..... F24C 15/20 |
| CN | 207006315 | | | 2/2018 | |
| CN | 207006315 | U | * | 2/2018 | |
| CN | 108799160 | A | * | 11/2018 | |
| CN | 110186082 | | | 8/2019 | |
| CN | 110186082 | A | * | 8/2019 | |
| CN | 209445454 | U | * | 9/2019 | |
| CN | 110594805 | | | 12/2019 | |
| CN | 110686297 | A | * | 1/2020 | ..... F24C 15/2071 |
| CN | 111022346 | A | * | 4/2020 | ..... F04D 25/0606 |
| CN | 111089067 | A | * | 5/2020 | |
| CN | 210662977 | U | * | 6/2020 | |
| CN | 210859267 | U | * | 6/2020 | |
| CN | 111435003 | | | 7/2020 | |
| EP | 3101350 | A1 | * | 12/2016 | ..... F04D 25/166 |
| EP | 3348912 | A1 | * | 7/2018 | ..... F24C 15/20 |

* cited by examiner

FAN SYSTEM, RANGE HOOD EQUIPPED WITH THE SAME, AND MOUNTING METHOD THEREOF

CROSS-REFERENCE TO RELATED APPLICATION

This application is a 371 of international application of PCT application serial no. PCT/CN2020/126721, filed on Nov. 5, 2020, which claims the priority benefit of China application no. 202011190585.X, filed on Oct. 30, 2020. The entirety of each of the above-mentioned patent applications is hereby incorporated by reference herein and made a part of this specification.

TECHNICAL FIELD

The present invention relates to an oil fume purification device, and in particular to a fan system, a range hood equipped with the fan system and a method for mounting a flow guide device in the range hood.

BACKGROUND ART

Range hoods have become one kind of indispensable kitchen appliances in modern families. Range hoods operate on the principle of fluid dynamics, suck and exhaust oil fume through centrifugal fans mounted inside the range hoods and filter some oil particles through filter screens. The centrifugal fan comprises a volute, an impeller mounted in the volute and a motor for driving the impeller to rotate. When the impeller rotates, a negative-pressure suction force is generated in the center of the fan, so that oil fume under the range hood is sucked into the fan, accelerated by the fan and then collected by the volute and guided to the outside.

At present, the range hood market has a plurality of horizontal (thin) range hoods. The range hoods are mainly characterized in that the fan system is disposed horizontally, the centrifugal fan system is generally used and the rotating shaft of the motor is vertical to the table of the cooker. For example, a Chinese Utility Model Patent CN207006315U (patent NO.:201720917014.9) disclosed an ultra-thin ceiling-mounted range hood, at least comprising a housing and an air supply component, wherein the air supply component comprises a fan volute, a motor matched with the fan volute and an impeller; the fan volute comprises a front cover having an air inlet formed thereon and an middle annular wall; the middle annular wall vertically connects the front cover by using a continuous smoothly-transited curved surface to form an inner flow passage opened upward and an air supply port.

The motor of the fan system is a power source, and the motor convert electric energy into rotation mechanical energy to drive the impeller to rotate so as to provide energy. As a power source, the motor itself has high requirements for fixation, and will produce vibration or the like. In the fan systems for horizontal range hoods, the motor is generally mounted in such a way that the motor is fixed on the box or the upper portion of the rear cover of the volute and the motor is fixed by means of the box and the rear cover of the volute. In this case, when the motor is to be disassembled, it is necessary to disassemble the impeller assembly of the volute, resulting in troubles in after-sales maintenance.

In the existing motor mounting mode, when the motor is placed from the air inlet of the volute for mounting, the motor hangs upside down vertically, and screws for fixing the motor enter from the air inlet of the volute. The motor screws are easy to loosen under working conditions, so that the motor has a risk of falling off after long-term operation. When the motor is placed from the rear cover of the volute, the motor is supported by the rear cover of the volute and the motor has no risk of falling off. However, in this case, the disassembly of the motor is complicated. Since the volute is assembled and fixed on the box and the distance between the box and the rear cover of the volute is relatively small, the motor cannot be taken out between the both. As a result, when the motor is to be assembled, it is necessary to disassemble the whole fan system, so that the whole operation is complicated and the operation task is heavy. In the process of disassembling the volute assembly, it is necessary to disassemble 14 screws, that is, six screws on the legs of the volute, four screws on the back plate of the box and four screws on the top of the box. Since the screws are located in different directions, the placement mode of the whole machine needs to be changed in the process of disassembling the screws, so that the whole disassembly is complicated.

In addition, the fan systems for horizontal range hoods are designed to discharge air from the circular top and discharge air from the square back. At present, the fan system is mainly mounted to discharge air from the circular top in most users' kitchens, and mounted to discharge air from the square back in few users' kitchens. However, since the air outlet of the fan system originally faces backward, if air needs to be discharged from the top, an air flow flowing from the air outlet needs to make a 90° turn and then be discharged upward. Therefore, it is necessary to provide a flow guide device at the air outlet. In order to satisfy users' mounting requirements and consider the users' convenience in disassembly, it is necessary to provide a method for mounting a flow guide device, which satisfies the requirements for the fit size of the fan system and also satisfies the requirements for convenient disassembly and replacement.

SUMMARY

It is a first object of the present invention to provide a fan system, which ensures the mounting safety and disassembly convenience of a motor and can also weaken the vibration of the whole machine.

It is a second object of the present invention to provide a range hood equipped with the fan system described above.

It is a third object of the present invention to provide a mounting method for a flow guide device of the range hood.

For achieving the first object, the fan system comprises a volute having a front cover, a rear cover and an annular wall connected between the front cover and the rear cover: an impeller disposed inside the volute; a motor for driving the impeller to rotate; wherein, the front cover has an air inlet, and the air inlet faces downward in the state when the fan system is mounted; the motor comprises a motor body and an edge disposing on the periphery of the motor body; the edge of the motor is connected and fixed to the rear cover at the side of the rear cover facing the air inlet.

In order to prevent the motor from loosening due to vibration during the operation process, preferably, the fan system further comprises an anti-loose ring; the rear cover of the volute has a mounting hole for receiving the motor, an annular mounting flange protrudes outward from the edge of the mounting hole; the anti-loose ring is mounted on a side of the mounting flange away from the air inlet, and the edge is connected and fixed to the anti-loose ring.

In order to further prevent the motor from loosening due to vibration during the operation process, preferably, the fan system further comprises a nylon self-locking nut, the nylon self-locking nut is embedded in the anti-loose ring, and the edge is locked with the nylon self-locking nut through a motor screw passing through the mounting flange.

For achieving the second object, the range hood equipped with the fan system comprises a housing and the fan system disposed inside the housing; wherein the front cover, the rear cover and the annular wall enclose together to form a first air outlet facing backward; the rear cover has a second air outlet facing upward, and the first air outlet and the second air outlet selectively discharge air.

In accordance with one aspect of the present invention, preferably, the housing comprises a back plate located on the rear side of the range hood; a first air outlet hood for connecting the fan system to an external fume discharge pipe is disposed on the back plate at a position corresponding to the first air outlet; and a top cover is disposed at the second air outlet on the rear cover of the volute to close the second air outlet, so as to discharge air from the rear side.

In accordance with another aspect of the present invention, preferably, a second air outlet hood for connecting the fan system to an external fume discharge pipe is disposed on the top of the housing at a position corresponding to the second air outlet; a flow guide device is disposed at the first air outlet, the flow guide device has a flow guide surface facing an air flow to guide out the air flow from the second air outlet; and the first air outlet is closed by a back cover, so as to discharge air from the top side.

For the convenience of assembly, preferably, the back cover is disposed on the outer side of the volute.

In order to facilitate the fixation of the volute to other components, preferably, the rear cover of the volute has a folding hole adjacent to the first air outlet, which has a folding edge protruding toward the inside of the volute, and the folding hole is used for mounting the second air outlet hood.

In order to avoid the interference between the flow guide device and the rear cover of the volute and also ensure the airtightness at the position where the flow guide device is located, preferably, the top of the flow guide device has an evading hole for receiving the folding edge of the folding hole.

Preferably, in order to further ensure the airtightness at the position where the flow guide device is located and also avoid the interference between the flow guide device and other components in the volute during mounting, the annular wall has a volute tongue; the rear end of the flow guide device away from the bottom of one side of the volute tongue and facing the first air outlet is defined as a first point, the front end of the flow guide device close to the top of one side of the volute tongue and away from the first air outlet is defined as a second point, in the state when the flow guide device is mounted, the line between the first point and the second point is a vertical line; the shortest distance from the first point on the flow guide device to the top surface of the flow guide device is the length of the line segment between the first point and the second point, which is equal to the height of the inner side of the volute.

For achieving the third object, the mounting method for the flow guide device of the range hood comprises the following steps:

1) placing the flow guide device outside a fan system and aligning with the first air outlet, and inclining the upper portion of the flow guide device at a predetermined angle in a direction away from the first air outlet;
2) moving the flow guide device from the rear side of the first air outlet of the volute to the inside of the volute at the inclination angle obtained in step 1), and stopping moving when the flow guide device is moved to contact with the volute tongue;
3) at the position reached in step 2), rotating the flow guide device about the first point in a direction toward the volute tongue, until the folding hole is inserted into the evading hole.

Compared with the prior art, the present invention has the following advantages. Since the motor is mounted from the air inlet, when the fan system is disposed horizontally, the motor can be conveniently disassembled and assembled. By providing the anti-loose ring and the nylon self-locking nut, the mounting safety and disassembly convenience of the motor can be ensured, and the vibration of the whole machine can be weakened. The flow guide device is disassembled or assembled in a rotating manner, so that the convenience of disassembly and assembly is ensured and the safety is also ensured.

DETAILED DESCRIPTION OF THE EMBODIMENTS

Figure 1:
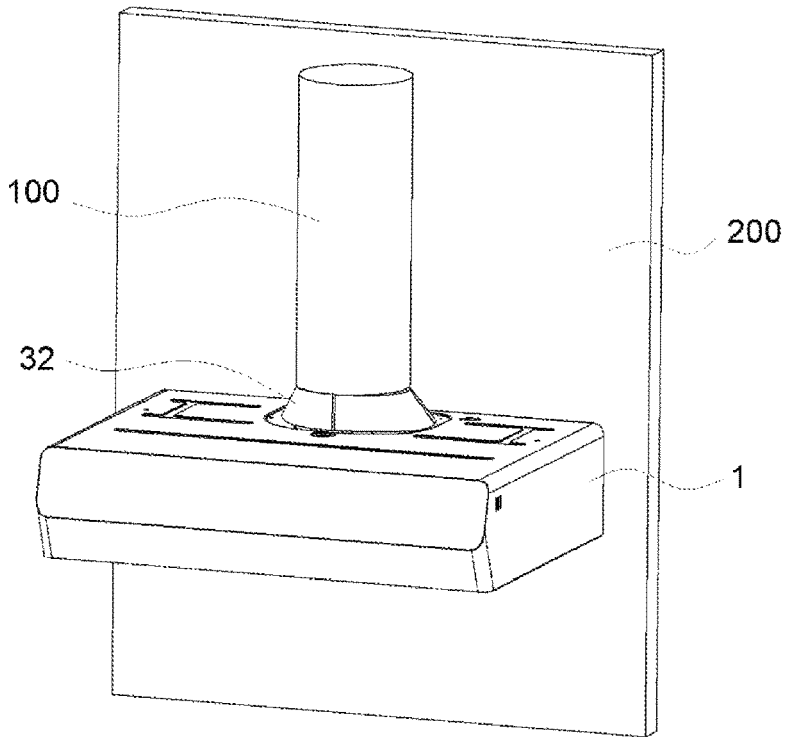
FIG. 1 is a perspective view of a range hood in a first mounted state according to an embodiment of the present invention.
Figure 2:
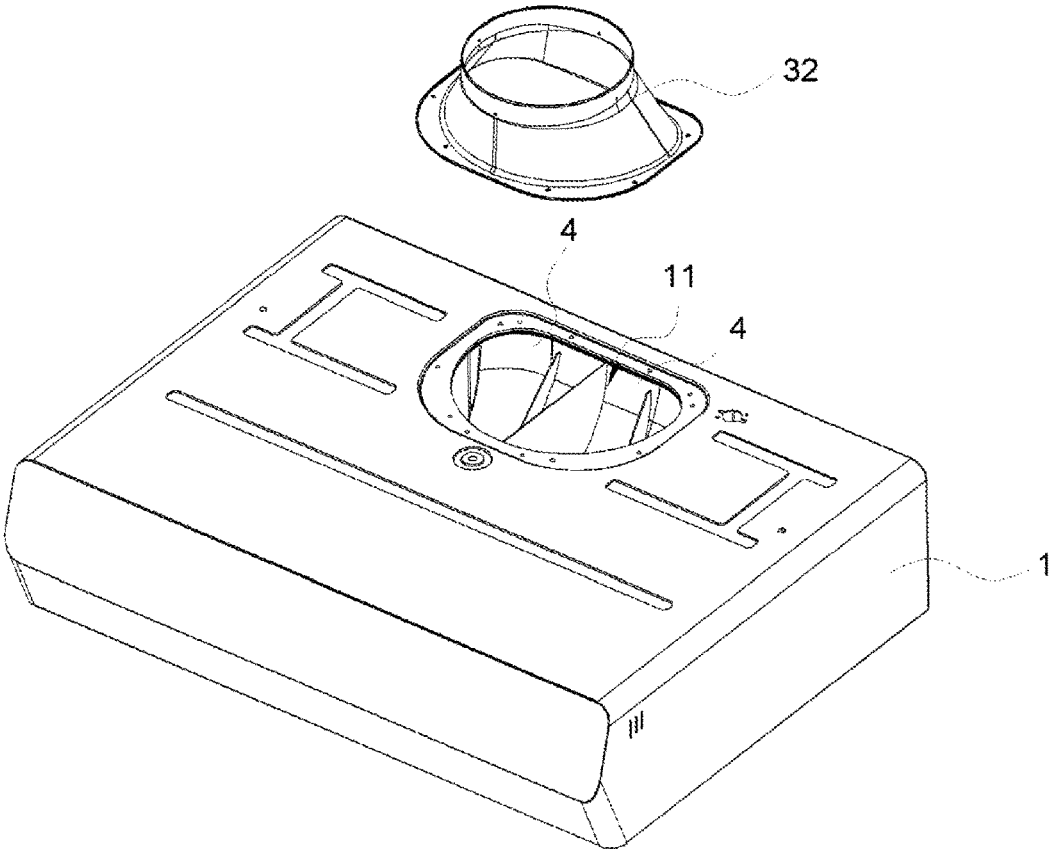
FIG. 2 is an exploded view of the range hood of FIG. 1.
Figure 3:
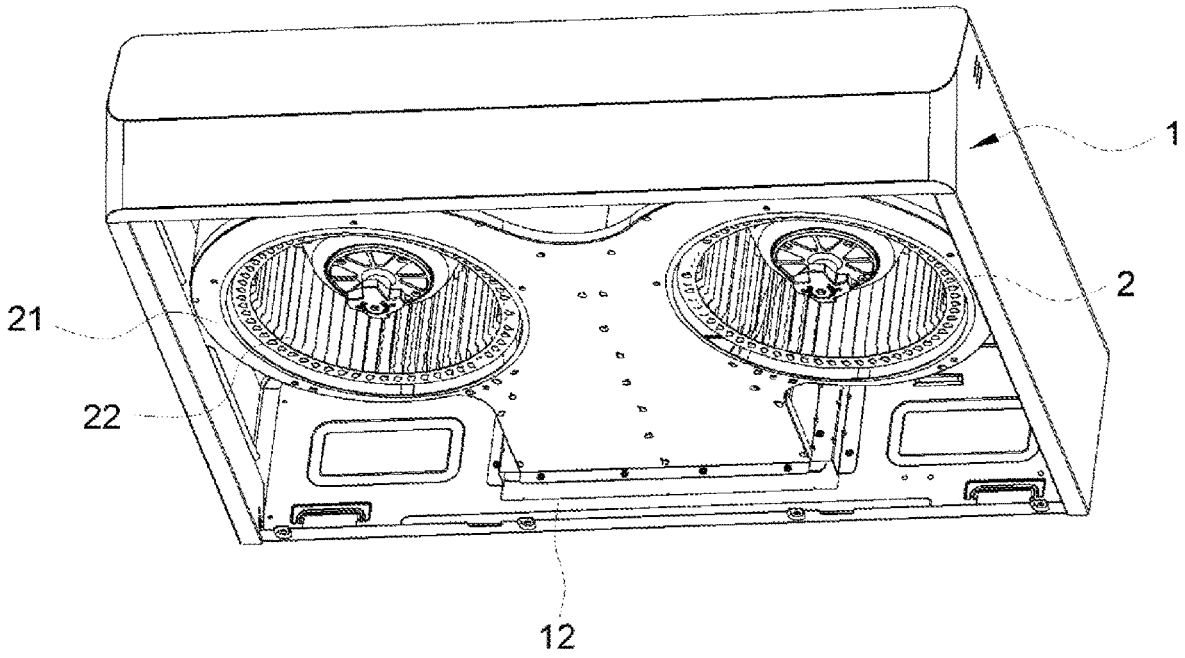
FIG. 3 is a perspective view of the range hood of FIG. 1 when viewed from the bottom.
Figure 4:
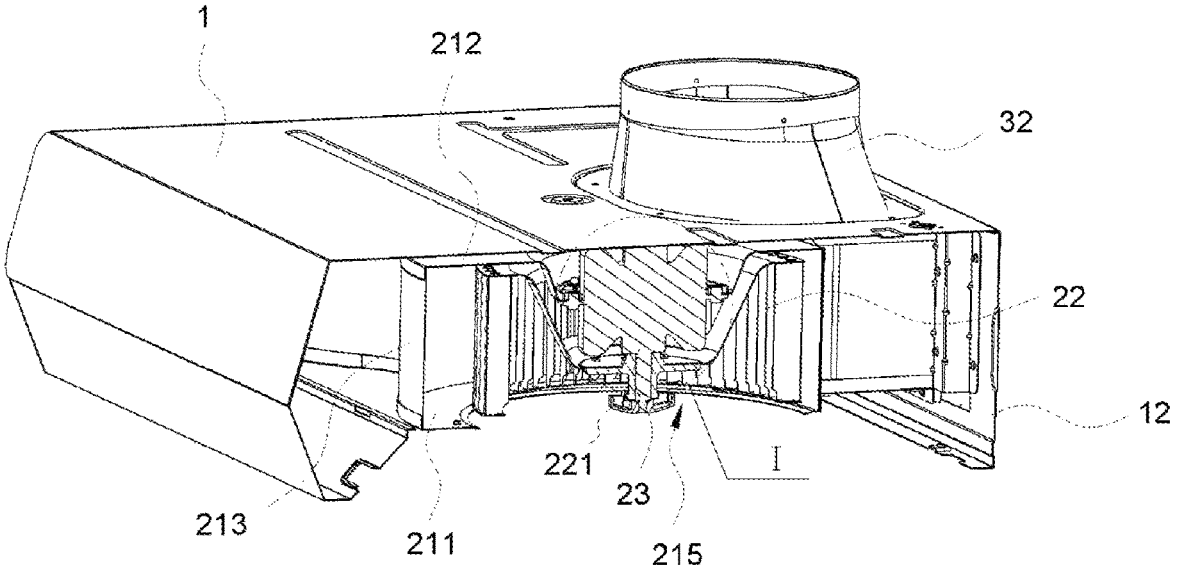
FIG. 4 is a sectional view of the range hood of FIG. 1.
Figure 5:
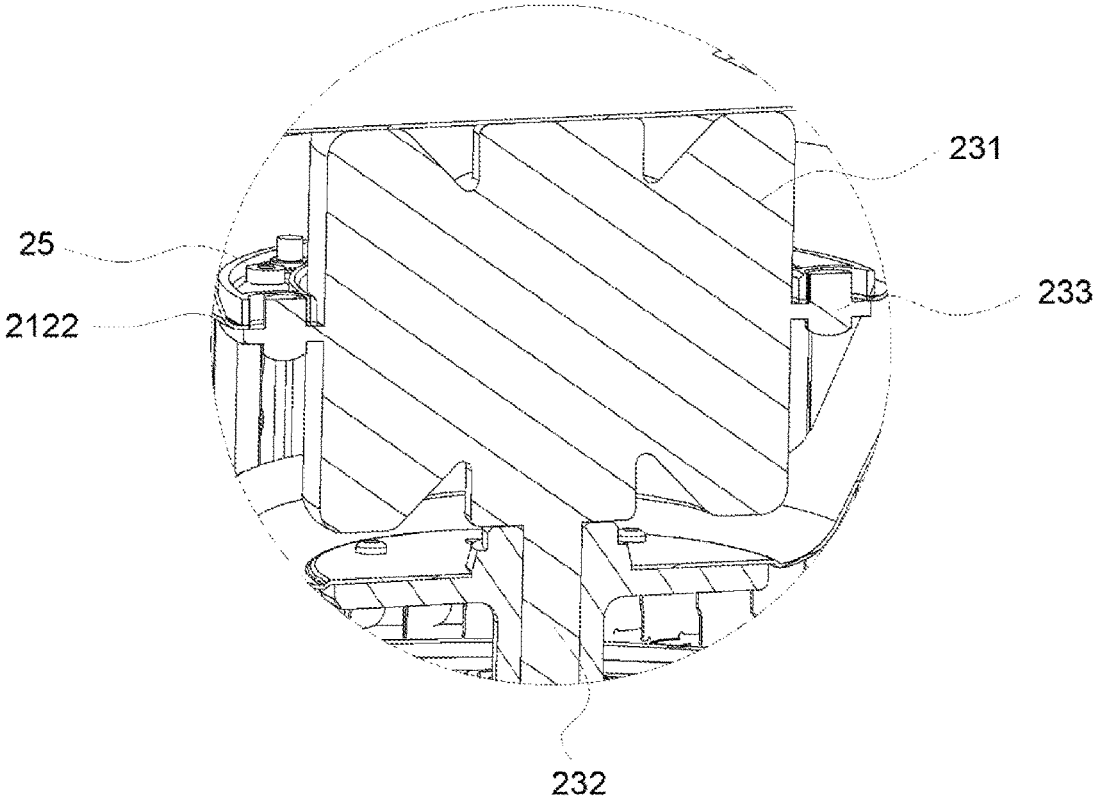
FIG. 5 is an enlarged view of part I of FIG. 4.
Figure 6:
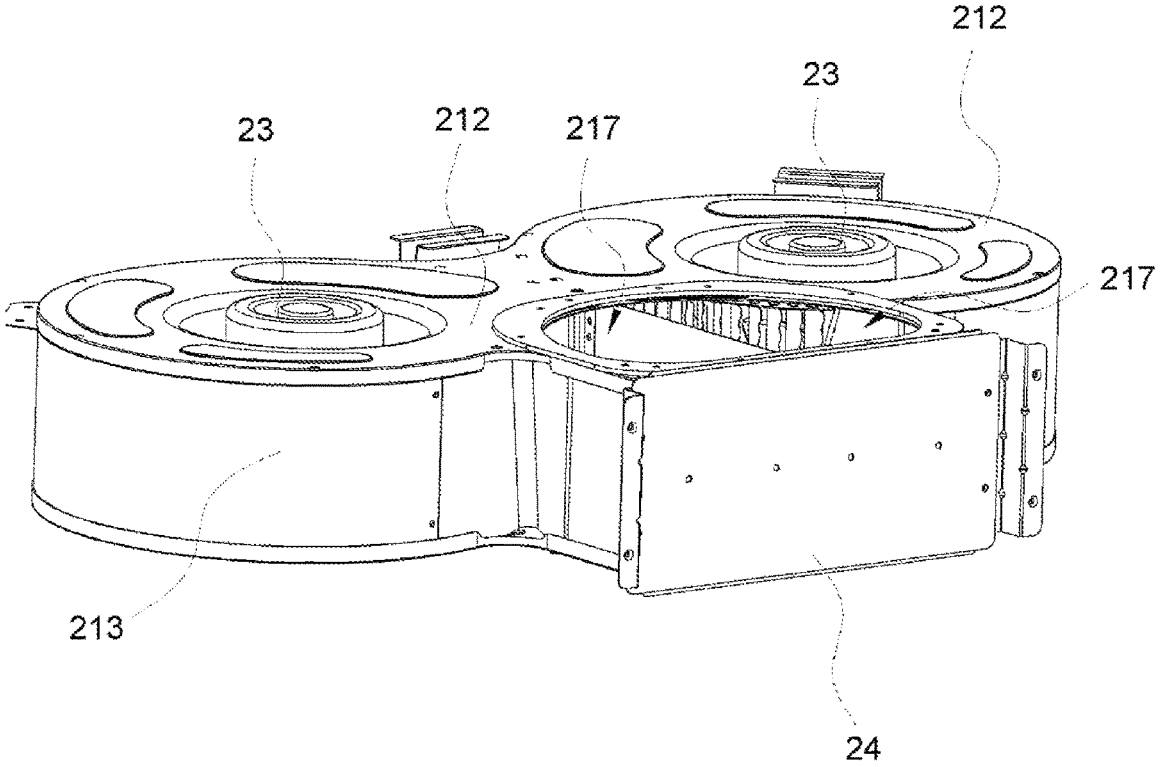
FIG. 6 is a perspective view of the range hood of FIG. 1 after the housing is omitted.
Figure 7:
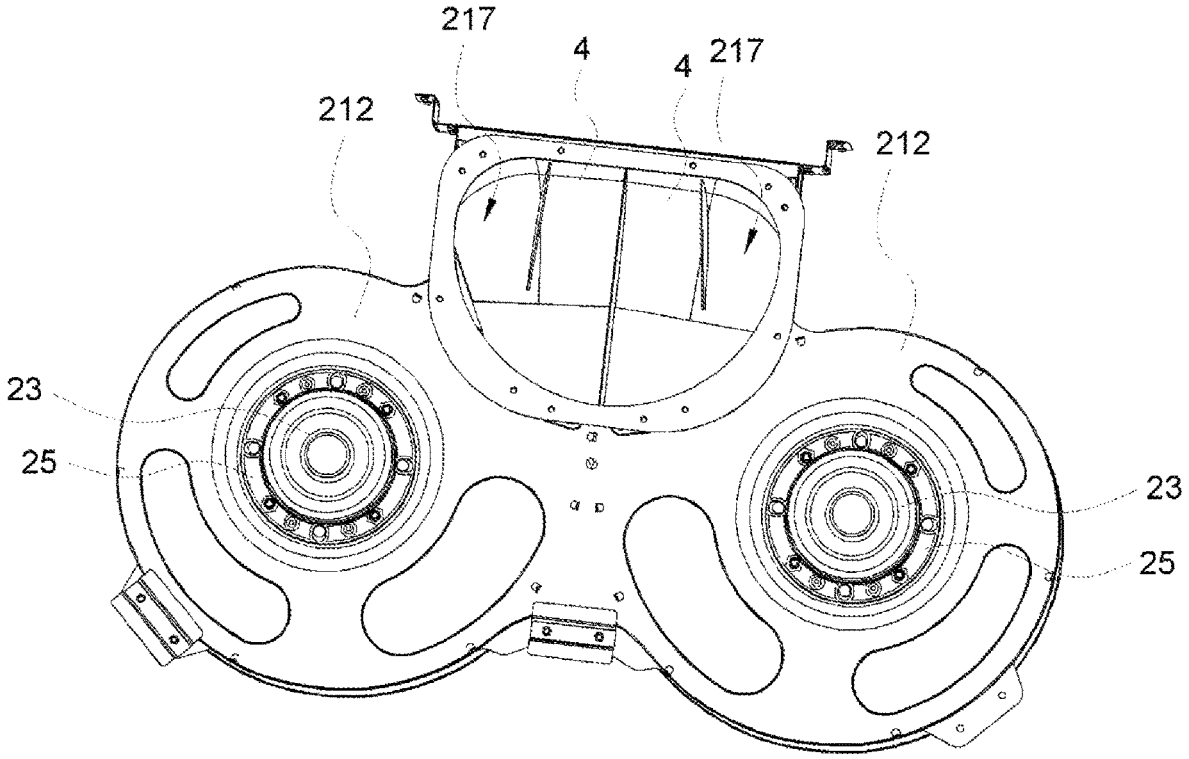
FIG. 7 is a perspective view of the fan system of the range hood of FIG. 1.
Figure 8:
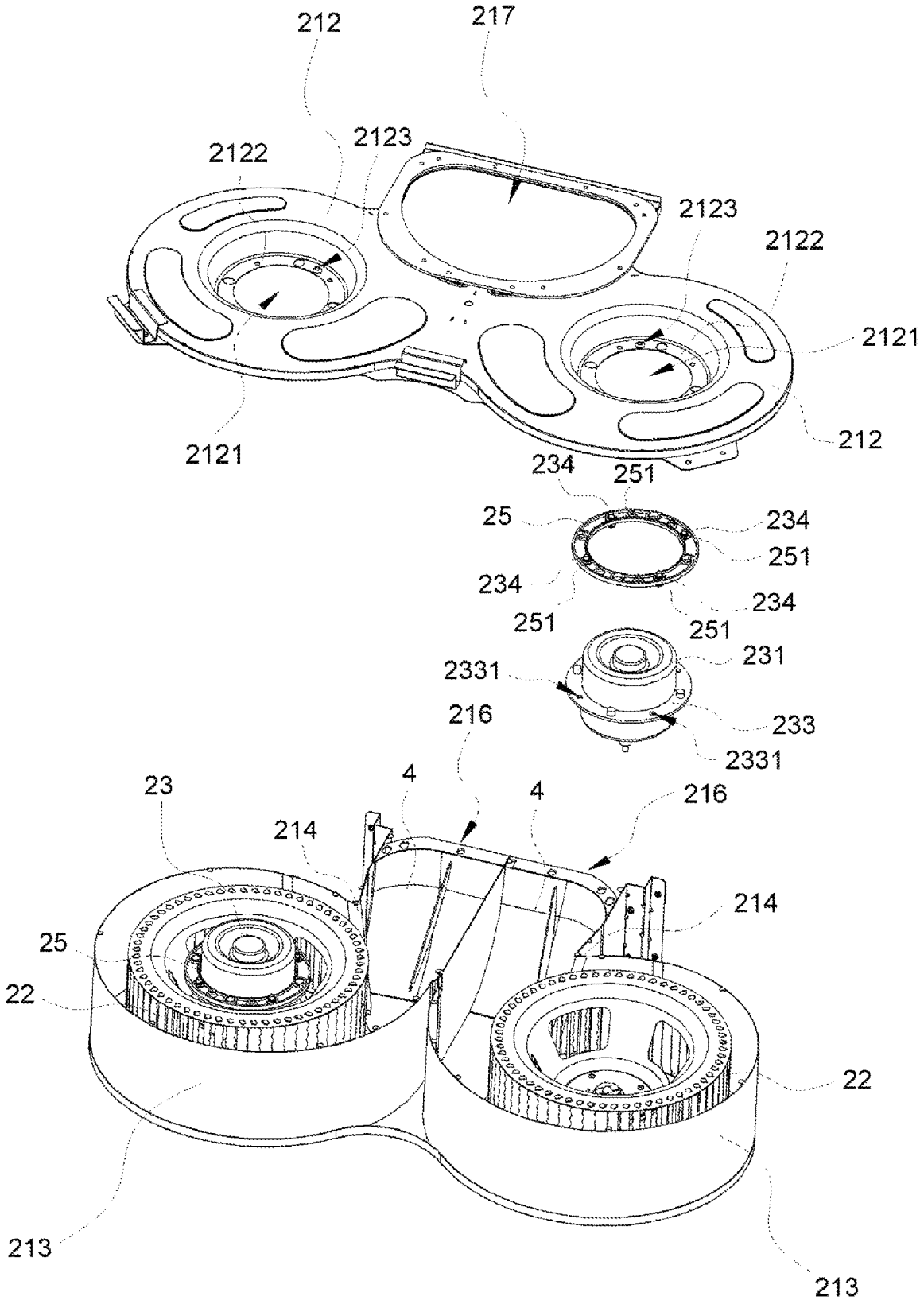
FIG. 8 is an exploded view of FIG. 7.
Figure 9:
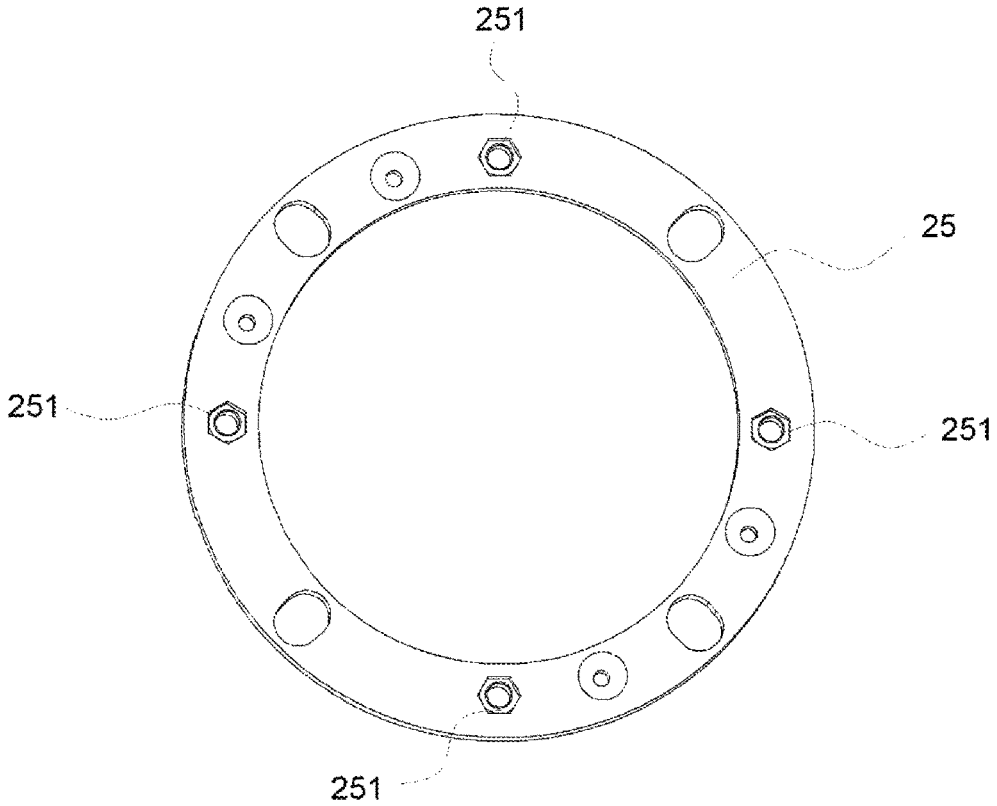
FIG. 9 is a perspective view of the anti-loose ring of the fan system of FIG. 7.

The embodiments of the present invention will be described below in detail. The examples of these embodiments have been illustrated in the accompanying drawings throughout which like or similar reference numerals indicate like or similar elements or elements having like or similar functions.

In the description of the present invention, it should be understood that, the orientation or positional relationship indicated by terms such as "center", "longitudinal", "transverse", "length", "width", "thickness", "upper", "lower", "front", "rear", "left", "right", "vertical", "horizontal", "top", "bottom", "inner", "outer", "clockwise", "anticlockwise", "axial", "radial" and "circumferential" is based on the orientation or positional relationship shown in the accompanying drawings, and is merely for the convenience of describing the present invention and simplifying the description, rather than indicating or implying the indicated device or element must has a particular orientation or be constructed and operated in a particular orientation. Since the embodiments disclosed in the present invention can be arranged in different directions, these terms indicating direction are merely for illustration and should not be construed as limitations. For example, "upper" and "lower" are not necessarily defined as directions opposite to or consistent with the direction of gravity. In addition, the features defined by the terms "first" and "second" may explicitly or implicitly comprise one or more features.

FIGS. 1-8 show a preferred embodiment of a range hood according to the present invention. The range hood is a horizontal range hood, and comprises a housing 1 and fan systems 2 disposed in the housing 1.

The fan systems 2 are centrifugal fans, and each comprises a volute 21, an impeller 22 disposed inside the volute 21 and a motor 23 for driving the impeller 22 to rotate. In this embodiment, there are two fan systems 2 disposed in parallel. The impeller 22 is connected to an output shaft of the motor 23 through a hand-tightened nut 221.

Each volute 21 has a front cover 211, a rear cover 212 and an annular wall 213 connected between the front cover 211 and the rear cover 212. A volute tongue 214 is formed on the annular wall 213. The front cover 211 is located below the rear cover 212, and the front cover 211 and the rear cover 212 are parallel to each other in the up-down direction. The front cover 211 has an air inlet 215, and the air inlet 215 faces downward to form a horizontal range hood. The front cover 211, the rear cover 212 and the annular wall 213 enclose together to form a first air outlet 216 facing backward. The volute tongue 214 distributes an air flow driven by the impeller 22 into the first air outlet 216, thereby preventing most of the air flow from flowing back to the volute 21.

The range hood of the present invention has two fume discharge and mounting modes. In the first mode, fume is discharged upward, and it is connected to a first fume discharge pipe 100. At this time, the first fume discharge pipe 100 is a hollow cylinder, and is disposed above the range hood. A second air outlet 217 is disposed on the rear cover 212 of the volute 21, the second air outlet 217 is opposite to the air inlet 215 in direction, and the air flow is discharged upward from the second air outlet 217. The position of the second air outlet 217 can correspond to the volute tongue 214. The rear cover 212 of the two volutes may be integrated, so that the two air outlets 217 are formed as a whole. In order to make the air flow originally flowing from the first air outlet 216 to make a 90° turn and discharged upward, a flow guide device 4 is disposed at the first air outlet 216, and the flow guide device 4 has a flow guide surface 41. The flow guide surface 41 faces the air flow. The flow guide device 4 blocks the first air outlet 216, thereby preventing oil fume from being discharged from the first air outlet 216. In order to further ensure the airtightness at the first air outlet 216, in this mounted state, a back cover 24 can be disposed at the first air outlet 216, so that oil fume will not be discharged from the first air outlet 216.

The range hood further comprises a second air outlet hood 32. A through hole 11 is disposed at a position on the top of the housing 1 corresponding to the second air outlet 217. The shape of the through hole 11 is the same as the overall shape of the two second air outlets 217. The second air outlet hood 32 is disposed above the housing 1 and covered at the through hole 11, so that the fan system 2 can be connected to the first fume discharge pipe 100 and it is convenient for oil fume discharged from the fan system 2 to enter the first fume discharge pipe 100. The second air outlet hood 32 in the present invention can be the same as the air outlet hood used in common range hoods in structure. The second air outlet hood 32 is in a square-to-round structure form.

The housing 1 further comprises a back plate 12 located on the rear side of the whole machine to mount and fix the whole range hood to a wall 200.

With reference to FIGS. 5, and 7-9, the motor 23 is used to drive the impeller 22 to rotate in the volute 21, and the motor 23 is vertically hung upside down and fixed in the volute 21. Since the motor 23 is a power source, the motor 23 has a vibration acceleration during operation. In addition, since the structural form of the motor 23 is an outsourcing standard part and the change to structure is very complicated, the structure of the motor 23 is basically fixed during product development. Therefore, to increase the mounting stability of the motor 23, only the mounting structure of the motor 23 is taken into consideration. In the present invention, each fan system 2 further comprises an anti-loose ring 25, the rear cover 212 of the volute 21 has a mounting hole 2121, and the rear cover 212 has an annular mounting flange 2122 protruding outward from the edge of the mounting hole 2121. The size and shape of the mounting flange 2122 are matched with those of the anti-loose ring 25, and the mounting flange 2122 is flat. The motor 23 comprises a motor body 231, an output shaft 232, an edge 233 and a motor screw 234. The edge 233 is disposed around the motor body 231, and the output shaft 232 is fixed to the impeller 22 through a hand-tightened nut 221.

A nylon self-locking nut 251 is disposed on the anti-loose ring 25. The nylon self-locking nut 251 is embedded in the anti-loose ring 25 made of plastics. The embedding means interference fit. The nylon self-locking nut 251 cannot rotate in the anti-loose ring 25, thereby ensuring the fastening of the motor screw 234. The anti-loose ring 25 is connected to the rear cover 212 of the volute 21 by two screws to form a whole. A first screw hole 2123 is disposed on the mounting flange 2122 of the rear cover 212 of the volute 21, and a second screw hole 2331 is disposed on the edge 233 of the motor 23. Preferably, the second screw hole 2133 on the motor 23 has a diameter of 6 mm, the motor screw 234 has a diameter of M5, the first screw hole 2123 on the volute 21 has a diameter of 6.3 mm, and the nylon self-locking nut 251 has a diameter of M5.

Prior to the mounting of the motor 23, the anti-loose ring 25 is firstly fixed above the mounting flange 2122. The fixation mode may be screws or the like. Then, the motor 23 is pushed from the air inlet 215 of the volute 21 from down to up until the edge 233 is resisted against the mounting flange 2122, and then the motor screw 234 passes through the mounting flange 2122 to be locked with the nylon self-locking nut 251 of the anti-loose ring 25.

During the whole connection process, the motor 23 is tightly connected to the anti-loose ring 25 through the motor screw 234. There is surface contact among the anti-loose ring 25, the edge 234 of the motor 23 and the mounting flange 2122 of the rear cover 212 of the volute 21. The surface contact can weaken the transmission of the vibration of the motor 23.

In this mounting mode, the mounting safety of the whole machine and the motor 23 can be ensured, and the disassembly convenience of the motor 23 can also be ensured. Firstly, in terms of the mounting safety of the motor 23, the motor screw 234 is fixed by the nylon self-locking nut 251, and the nylon self-locking nut 251 is a novel fastening part with high anti-vibration and anti-loose performance. This is because the nylon self-locking nut has much higher anti-vibration and anti-loose performance than other anti-loose devices and has a vibration life that is several times or even dozens of times longer than that of other anti-loose devices. At present, more than 80% of mechanical equipment accidents are caused by loosening of fasteners. By using the nylon self-locking nut 251, major accidents caused by loosening of fasteners can be eliminated. In accordance with the advantages of the nylon self-locking nut 251 itself, by fixing the motor screw 234 using the nylon self-locking nut 251, it can be ensured that the motor 23 will not be loose even if it vibrates, the safety of the motor 23 on the whole machine even under severe conditions can be ensured, and the risk of loosening will not occur.

Secondly, in terms of the disassembly/assembly convenience of the motor, the nylon self-locking nut 251 is fixed above the rear cover 212 of the volute 21, and the motor 23 is placed at the rear cover 212 of the volute 21 from the air inlet 215 of the volute 21, so that the mounting convenience of the motor 23 is ensured.

When it is necessary to disassemble the fan system 2, the hand-tightened nut 221 is firstly disassembled, followed by the impeller 22 and finally the motor 23.

With reference to FIGS. 17-20, the range hood is mounted to discharge air from the top. When air needs to be discharged from the back, the fan system 2 is connected to a second fume discharge pipe 101. At this time, a top cover 26 is disposed at the second air outlet 217 of the rear cover 212 of the volute 21 to close the second air outlet 217. At this time, the first air outlet 216 communicates the inside of the volute 21 with the outside of the range hood, that is, it is unnecessary to dispose a back cover 24 at the first air outlet 216. Meanwhile, since the air flow can be discharged from the first air outlet 216 without making a 90° turn, it is unnecessary to dispose the flow guide device 4.

The housing 1 comprises a back plate 12 located on the rear side of the range hood. Similar to the mode where air is discharged from the top, a through hole (not shown) can also be formed at a position on the back plate 12 of the housing 1 corresponding to the first air outlet 216 to facilitate the flowing of the air flow. A first air outlet hood 31 is disposed at the first air outlet 216. Similar to the existing air outlet hoods, the first air outlet hood 31 also has a check valve 311. The two first air outlets 216 share one first air outlet hood 31. The wall 200 is located on the rear side of the first air outlet hood 31. A perforation 201 is formed at a position on the wall 200 corresponding to the first air outlet hood 31. The second fume discharge pipe 101 is mounted at the end of the first air outlet hood 31 away from the first air outlet 216 and passes through the perforation 201 to the rear side of the wall 200. In the present invention, the second fume discharge pipe 102 is a square pipe, and the first air outlet hood 31 is of a square-to-square hood structure.

To sum up, when the range hood discharges air from the top, the flow guide device 4 and the back cover 24 are hermetically assembled; and, when the range hood discharges air from the back, a top cover 26 is used for sealing. During the whole disassembly/replacement process, both the top cover 26 and the back cover 24 are located outside the volute 21, so that it is convenient for assembly.

Figure 10:
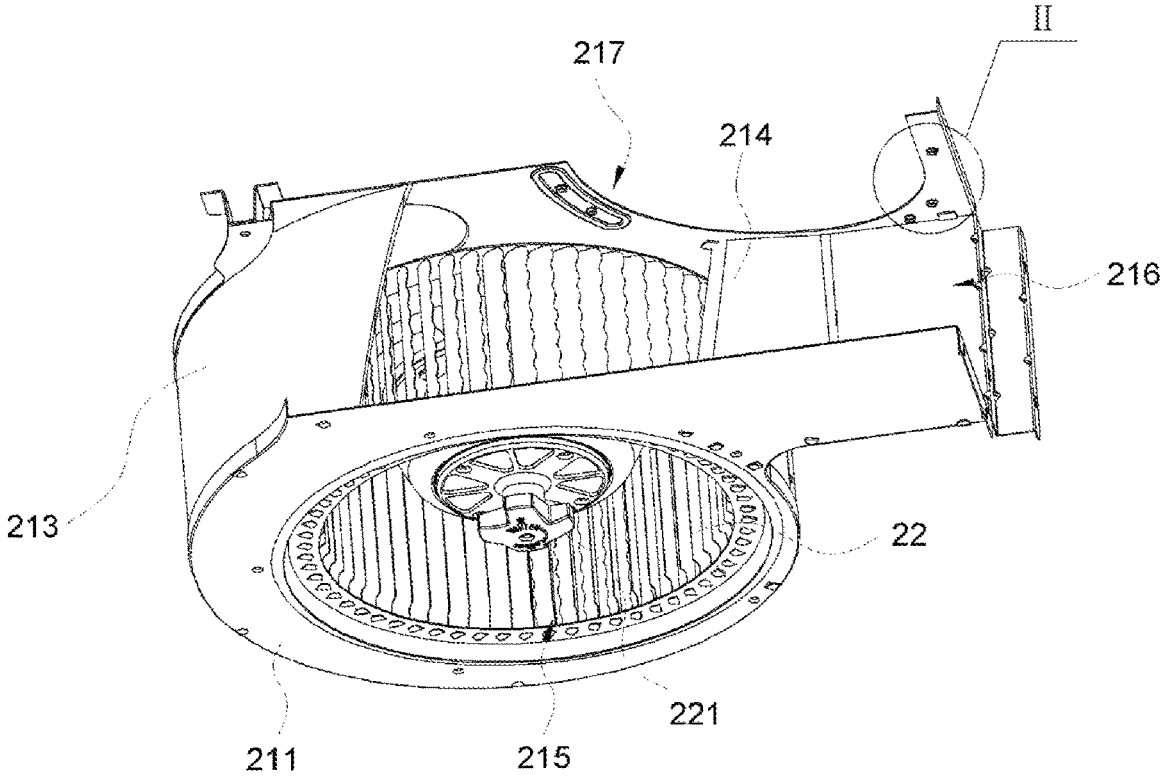
FIG. 10 is a perspective view of the fan system of FIG. 7 after the flow guide device is omitted.
Figure 11:
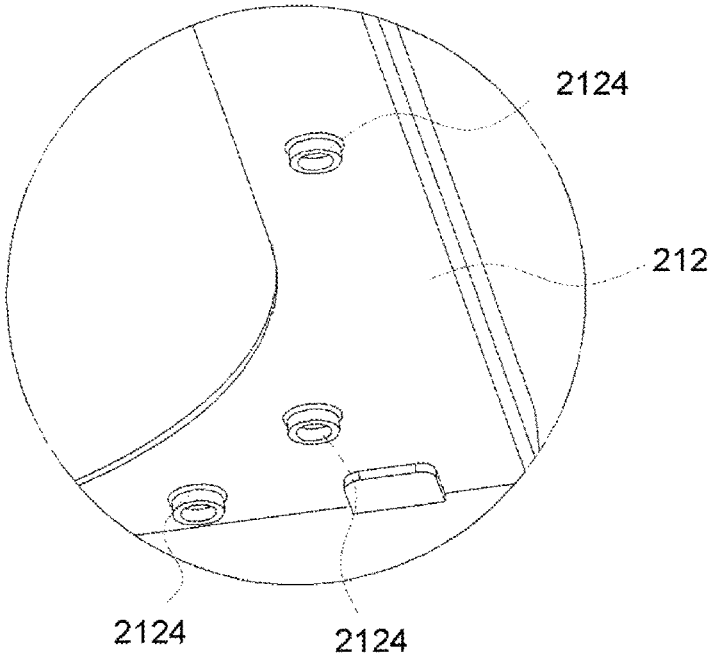
FIG. 11 is an enlarged view of part II of FIG. 10.
Figure 12:
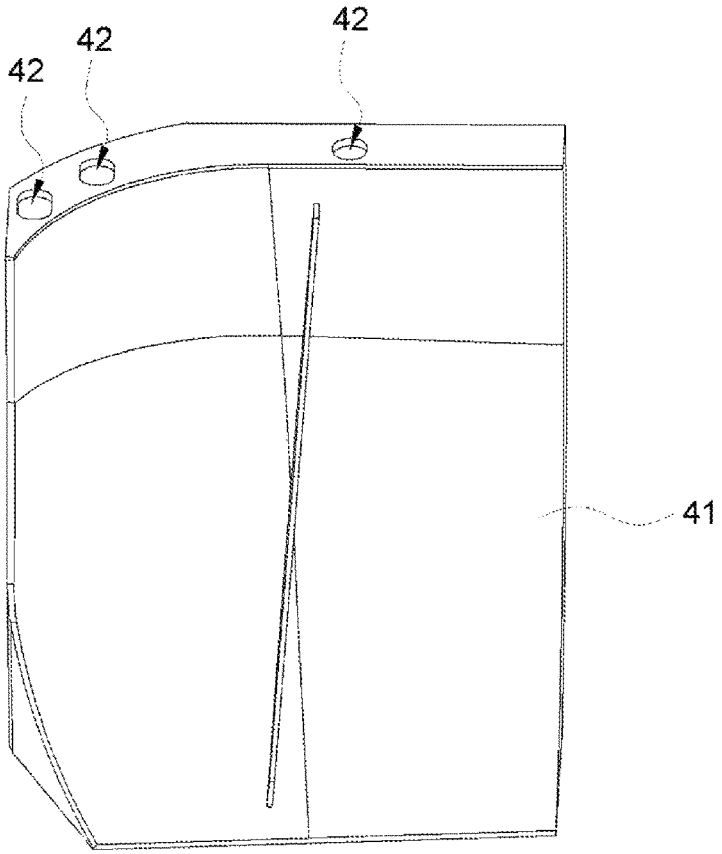
FIG. 12 is a front view of the flow guide device of the range hood according to the embodiment of the present invention.

With reference to FIGS. 10 and 11, the rear cover 212 of the volute 21 has a folding hole 2124 adjacent to the first air outlet 216, which has a folding edge protruding toward the inside of the volute 21. With reference to FIG. 12, the top of the flow guide device 4 has an evading hole 42 fitted with the folding hole 2124 to evade the folding hole 2124. The second air outlet hood 32 can enter the folding hole 2124 to be locked by screws or the like, so that the second air outlet hood 32 is connected and fixed to the rear cover 212 of the volute 21. The folding hole 2124 can increase the area of engagement with the screw, so that the connection between the second air outlet hood 32 and the rear cover 212 is more stable.

Figure 13:
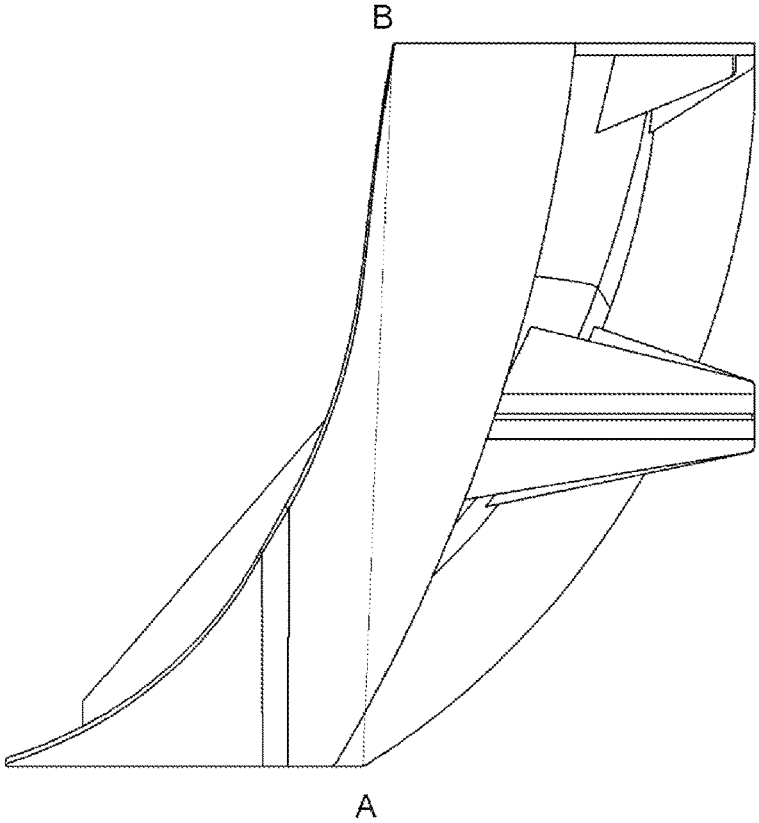
FIG. 13 is a side view of the flow guide device of the range hood according to the embodiment of the present invention.

With reference to FIG. 13, the rear end of the flow guide device 4 away from the bottom of one side of the volute tongue 214 and facing the first air outlet 216 is defined as a first point A, the front end of the flow guide device 4 close to the top of one side of the volute tongue 214 and away from the first air outlet 216 is defined as a second point B, in the state when the flow guide device 4 is mounted, the line between the first point A and the second point B is a vertical line.

The volute 21 is a sheet metal part, and the flow guide device 4 is a plastic part. The volute 21 and the flow guide device 4 are assembled to form an internal flow field space where air enters from the air inlet 215 and exits from the second air outlet 217 and other regions are hermetic. That is, except for the air inlet 215 and the second air outlet 217, other regions have no air flow and external flow. This is to avoid unnecessary aerodynamic noise caused by leakage of air flow pressure in the volute 21.

In order to satisfy the requirement that other regions except for the air inlet/outlet 215, 217 in the volute 21 have no air flow exchange with the outside, during the assembling of the volute 21 and the flow guide device 4, no gaps are required in design and fit. However, the flow guide device 4 is disposed in the volute 21, so the assembly space is limited. In addition, since the volute 21 is connected to components such as the second air outlet hood 32 and the flow guide device 4, features such as screw holes are inevitable. As shown in FIG. 11, the rear cover 212 has a folding hole 2124 or other bosses, these protruded structures obviously hinder the mounting of the flow guide device 4. Since the mounting space is not planar, mounting in place or reliable mounting cannot be realized, so that it is likely to lead to a risk of falling off and the airtightness cannot be satisfied.

In order to ensure the mounting safety of components and ensure that installers and others easily change the air discharge mode, the present invention adopts a novel method for mounting the flow guide device 4. The first point A serves as the rotation center of assembly. Since A and B are on a vertical line, the shortest distance from the first point A on the flow guide device 4 to the top surface of the flow guide device 4 is the length of the line segment between the first point A and the second point B, which is equal to the height of the inner side of the volute 21 (the height between the front cover 211 and the inner side of the rear cover 212). In a state where the flow guide device 4 is mounted in the volute 21, upper, lower, left and right sides are closely attached to the corresponding positions of the volute 21.

The flow guide device 4 is assembled by the following steps.

Figure 14:
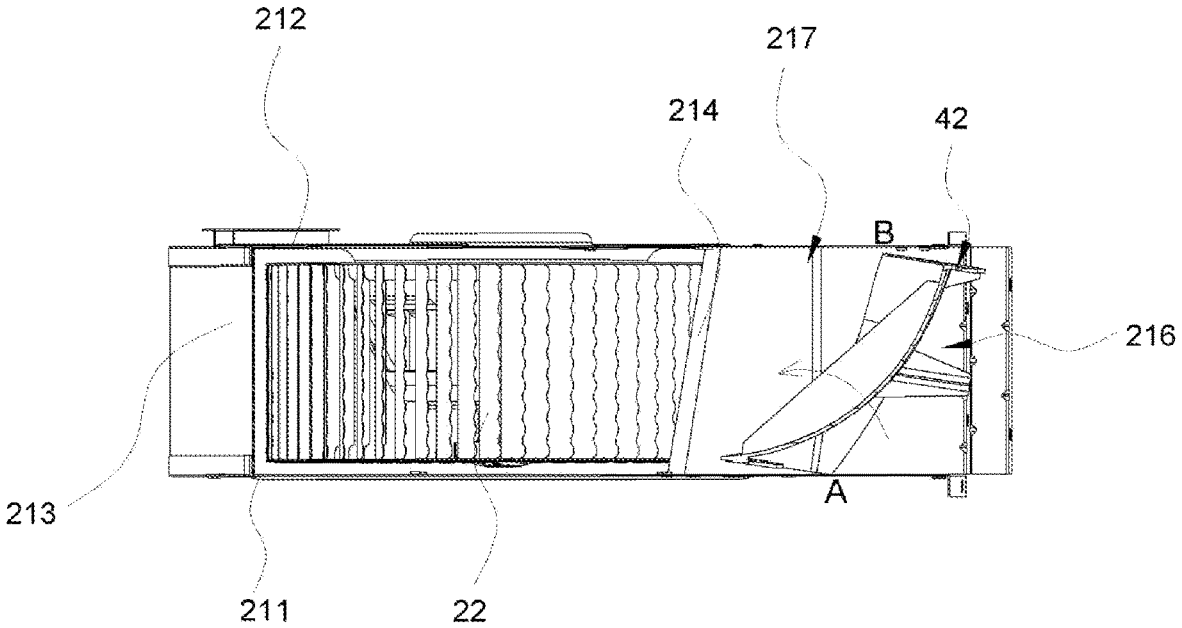
FIG. 14 is a perspective view of a process of mounting the flow guide device of the range hood according to the embodiment of the present invention.

(1) With reference to FIG. 14, placing the flow guide device 4 outside a fan system and aligning with the first air outlet 216, and inclining the upper portion of the flow guide device 4 at a certain angle in a direction away from the first air outlet 216 (such as 10° to 60°) in a direction away from the first air outlet 216. In FIG. 14, the upper portion of the flow guide device 4 is inclined clockwise.

(2) Moving the flow guide device 4 from the rear side of the first air outlet 216 of the volute 21 to the inside of the volute 21 at the inclination angle obtained in step 1), and stopping moving when the flow guide device 4 is moved to contact with the volute tongue 214.

Figure 15:
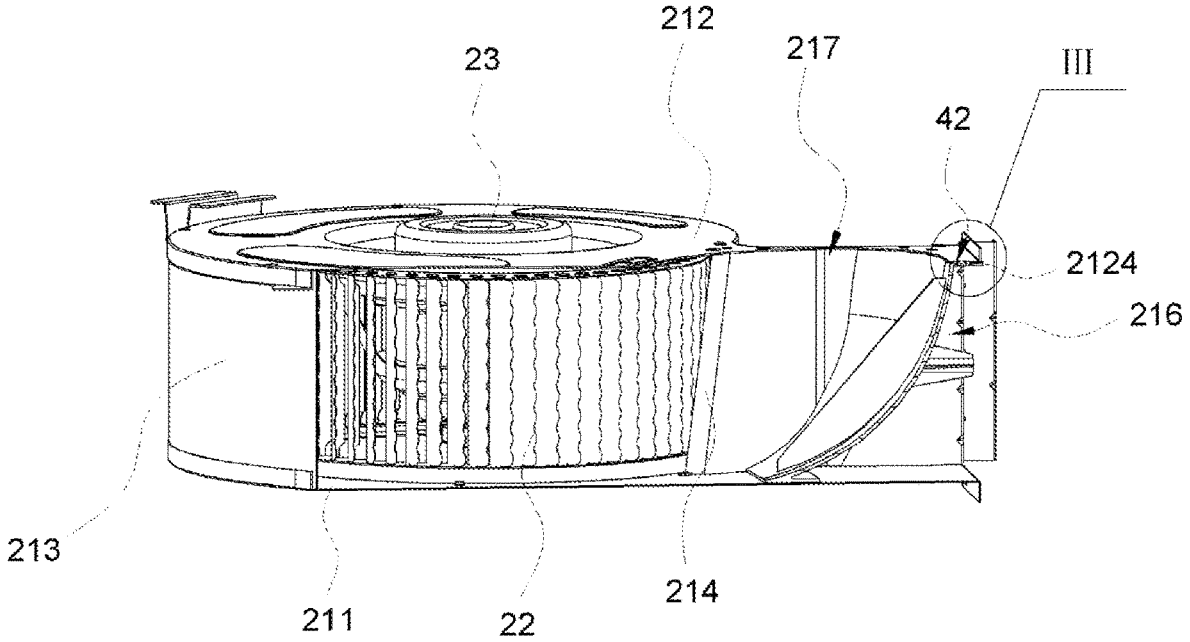
FIG. 15 is a perspective view after the flow guide device of the range hood is mounted according to the embodiment of the present invention.
Figure 16:
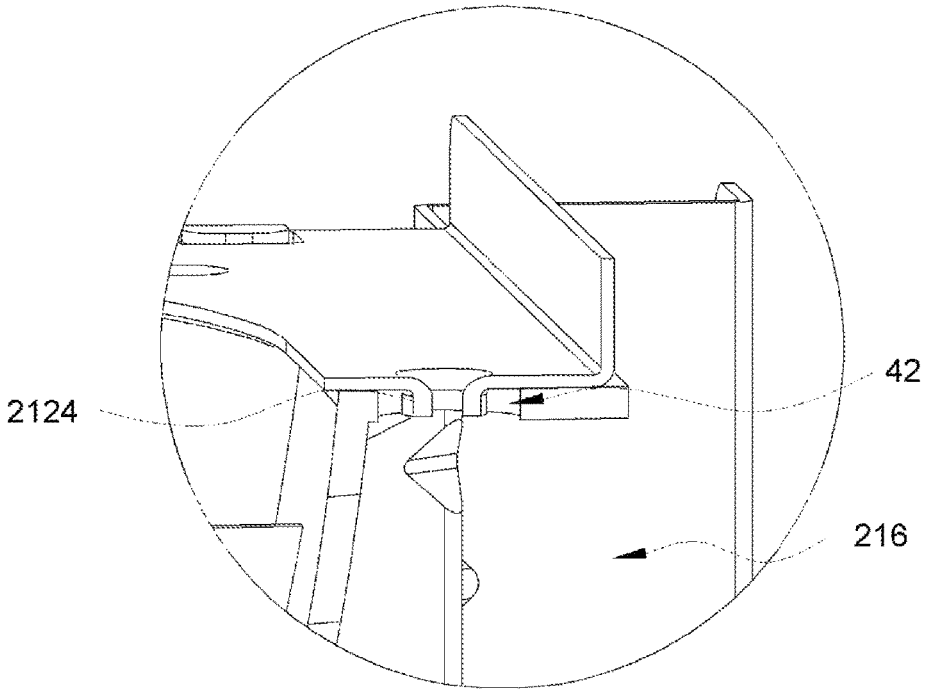
FIG. 16 is an enlarged view of part III of FIG. 15.
Figure 17:
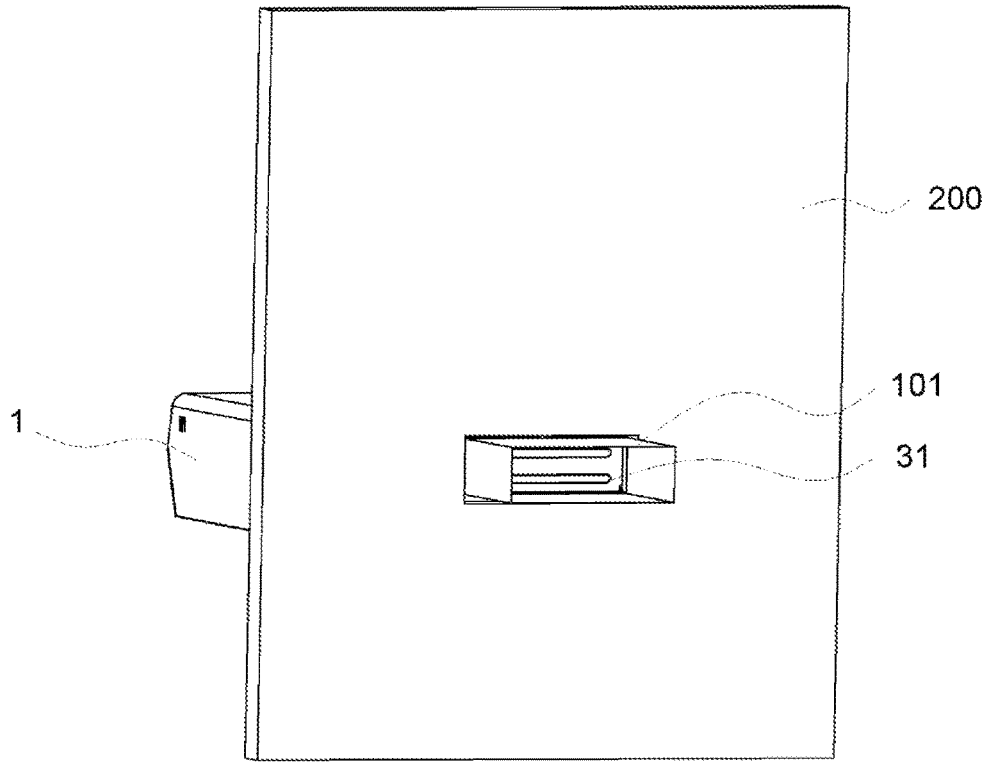
FIG. 17 is a perspective view of a range hood in a second mounted state according to the embodiment of the present invention.
Figure 18:
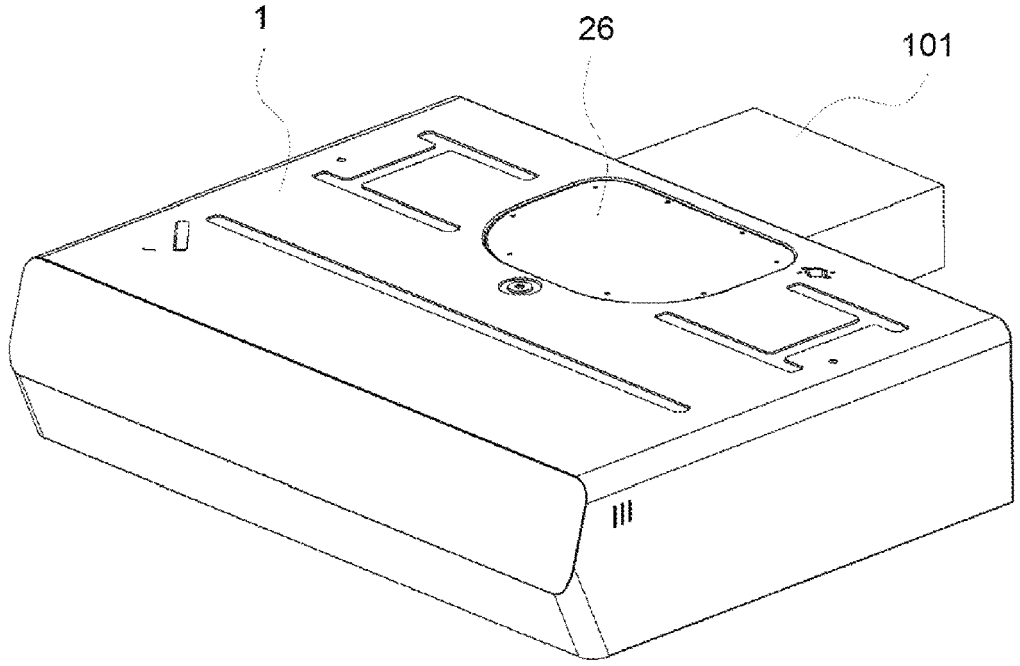
FIG. 18 is a perspective view of FIG. 17 after the wall is omitted.
Figure 19:
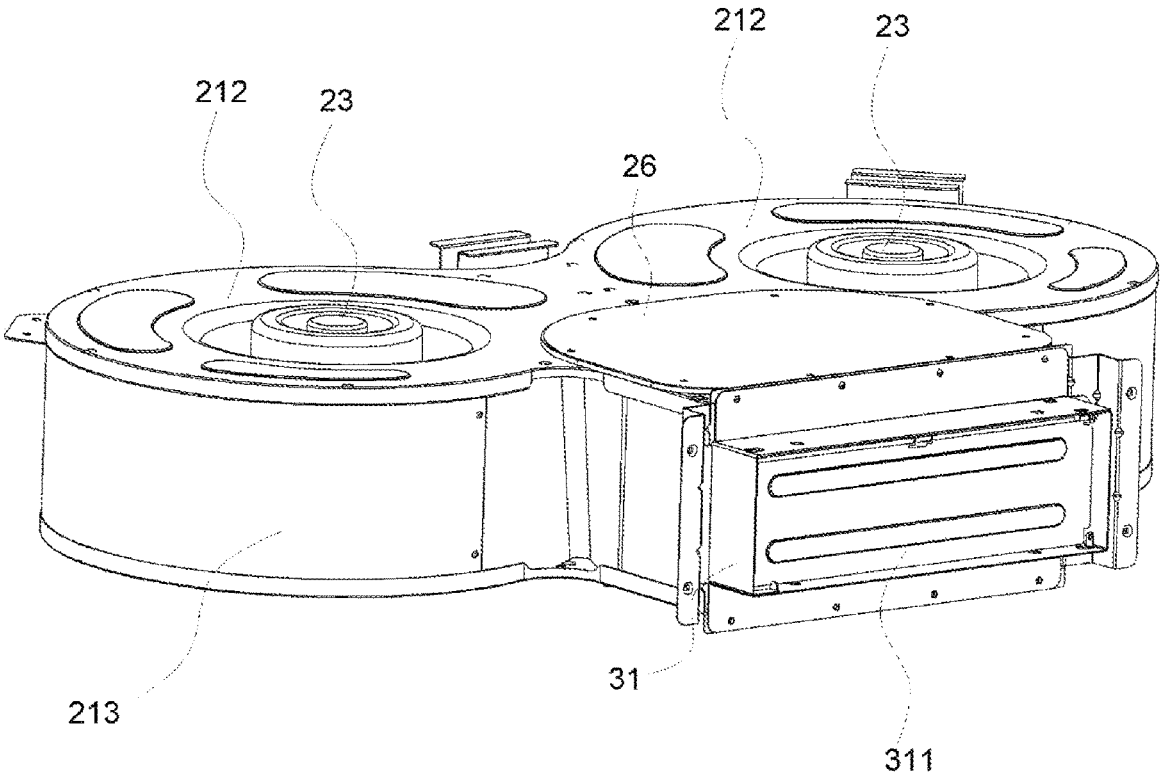
FIG. 19 is a perspective view of FIG. 18 after the second air outlet hood is omitted.
Figure 20:
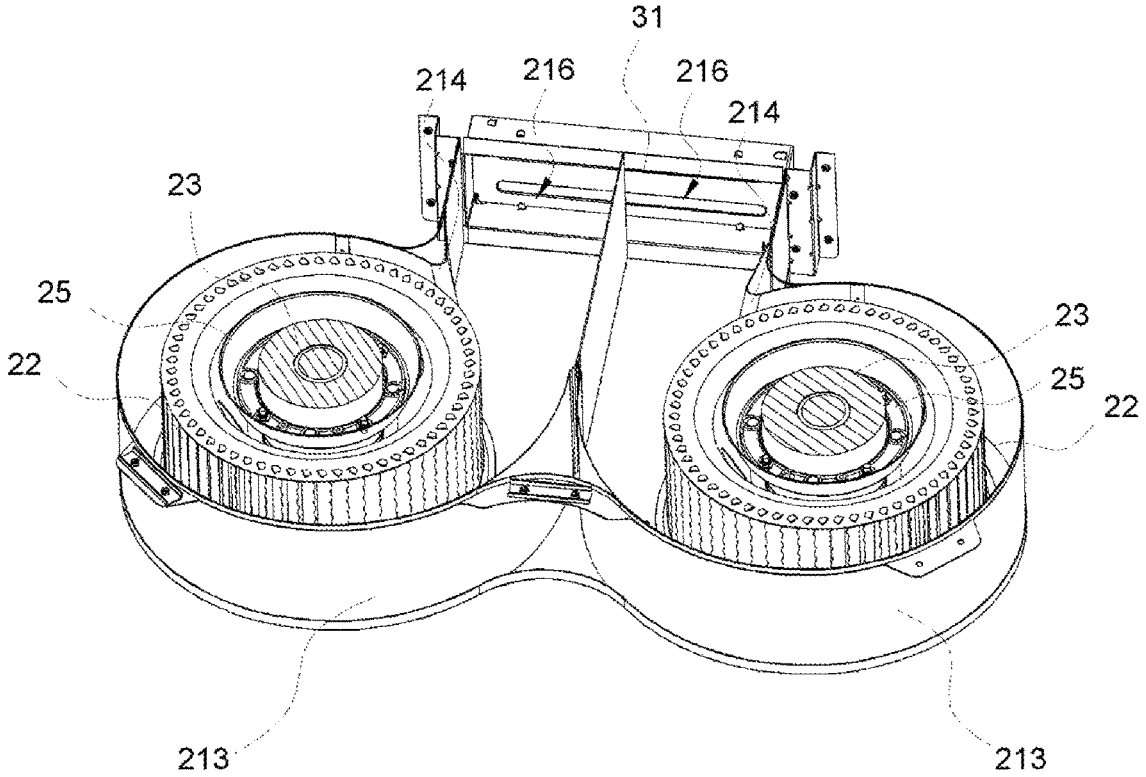
FIG. 20 is a sectional view of the range hood of FIG. 19 after the housing is omitted.

(3) At the position reached in step 2), rotating the flow guide device 4 about the first point A in a direction toward the volute tongue 214. Since AB is the shortest distance during rotation, there will be no interference with other components during rotation until the folding hole 2124 is inserted into the evading hole 42, with reference to FIGS. 15 and 16. The evading hole 42 is preferably a waist-shaped hole. There may be three waist-shaped holes which respectively are 13.5 mm, 12 mm and 9.5 mm in size, and the semicircle of each waist-shaped hole has a diameter of 8 mm. The three waist-shaped holes are not large, and the structural strength of the top surface of the flow guide device 4 can be satisfied. If the holes are large, the top surface has small structural contact area and low strength, so that the strength requirements cannot be satisfied.

The flow guide device 4 is mounted in this rotating manner, so it can be ensured the flow guide device 4 and the volute 21 are completely fitted to ensure airtightness, and it can also be ensured that the flow guide device 4 is normally disassembled or assembled.

What is claimed is:

1. A fan system, comprising: a volute; an impeller disposed inside the volute; and a motor for driving the impeller to rotate, wherein the volute has a front cover, a rear cover and an annular wall connected between the front cover and the rear cover; the front cover has an air inlet; the air inlet faces downward; and the motor comprises a motor body and an edge disposed on a periphery of the motor body, wherein the edge of the motor is connected and fixed to the rear cover at a side of the rear cover facing the air inlet, wherein the fan system further comprises an anti-loose ring; the rear cover of the volute has a mounting hole for receiving the motor; the mounting hole is defined by an edge of an annular mounting flange protruding inward from the rear cover; the anti-loose ring is mounted on a side of the mounting flange away from the air inlet; and the edge of the motor is connected and fixed to the anti-loose ring, and wherein the fan system further comprises a nylon self-locking nut; the nylon self-locking nut is embedded in the anti-loose ring; and the edge of the motor is locked with the nylon self-locking nut through a motor screw passing through the mounting flange.

2. A range hood equipped with the fan system of claim 1, comprising a housing, wherein the fan system is disposed inside the housing; wherein the front cover, the rear cover and the annular wall enclose together to form a first air outlet facing a rear side of the range hood; the rear cover has a second air outlet facing a top of the housing; and the first air outlet and the second air outlet selectively discharge air.

3. The range hood of claim 2, wherein the housing comprises a back plate located on the rear side of the range hood; a first air outlet hood for connecting the fan system to an external fume discharge pipe that is disposed on the back plate at a position corresponding to the first air outlet; and a top cover is disposed at the second air outlet on the rear cover of the volute to close the second air outlet, so as to discharge air from the rear side.

4. The range hood of claim 3, wherein a second air outlet hood for connecting the fan system to an external fume discharge pipe is disposed on the top of the housing at a position corresponding to the second air outlet; a flow guide device is disposed at the first air outlet; the flow guide device has a flow guide surface facing an air flow to guide out the air flow from the second air outlet; and the first air outlet is closed by a back cover, so as to discharge air from the top of the housing.

5. The range hood of claim 4, wherein the back cover is disposed on an outer side of the volute.

6. The range hood of claim 4, wherein the rear cover of the volute has a first hole adjacent to the first air outlet, wherein the first hole is defined by a folding edge protruding toward the inside of the volute, and the first hole is used for mounting the second air outlet hood.

7. The range hood of claim 6, wherein a top of the flow guide device has a second hole for receiving the folding edge of the first hole.

8. The range hood of claim 7, wherein the annular wall has a volute tongue; a rear end of the flow guide device away from a bottom of one side of the volute tongue and facing the first air outlet is defined as a first point, a front end of the flow guide device facing a top of one side of the volute tongue and away from the first air outlet is defined as a second point, and in a state when the flow guide device is mounted, a line between the first point and the second point is a vertical line; wherein a shortest distance from the first point on the flow guide device to a top surface of the flow guide device is a length of a line segment between the first point and the second point, which is equal to a height of an inner side of the volute.

9. A mounting method for the flow guide device of the range hood of claim 8, wherein the mounting method comprises the following steps:

1) placing the flow guide device outside the fan system, aligning the flow guide device with the first air outlet, and inclining an upper portion of the flow guide device at a predetermined angle in a direction away from the first air outlet;

2) moving the flow guide device from arear side of the first air outlet of the volute to the inside of the volute at the predetermined angle obtained in step 1), and stopping moving when the flow guide device contacts the volute tongue; and 3) at a position reached in step 2), rotating the flow guide device about the first point in a direction toward the volute tongue, until the first hole is inserted into the second hole.

* * * * *